US007043043B2

(12) United States Patent
Kakinuma

(10) Patent No.: US 7,043,043 B2
(45) **Date of Patent: *May 9, 2006**

(54) MICROPHONE APPARATUS

(75) Inventor: Hideaki Kakinuma, Tokyo (JP)

(73) Assignee: Vertex Standard Company, Ltd., Tokyo (JP)

( * ) Notice: Subject to any disclaimer, the term of this patent is extended or adjusted under 35 U.S.C. 154(b) by 78 days.

This patent is subject to a terminal disclaimer.

(21) Appl. No.: 10/909,172

(22) Filed: Jul. 29, 2004

(65) Prior Publication Data

US 2005/0008182 A1 Jan. 13, 2005

Related U.S. Application Data

(63) Continuation of application No. 10/442,545, filed on May 21, 2003, now Pat. No. 6,771,789, which is a continuation of application No. 09/805,307, filed on Mar. 12, 2001, now Pat. No. 6,590,988.

(30) Foreign Application Priority Data

Mar. 15, 2000 (JP) ..... 2000-072333

(51) Int. Cl.
*H04R 11/04* (2006.01)

(52) U.S. Cl. ..... 381/361; 381/356

(58) Field of Classification Search ..... 381/313, 381/355, 356, 357, 358, 360, 361, 369; 181/175, 181/176, 197, 206, 207, 209
See application file for complete search history.

(56) References Cited

U.S. PATENT DOCUMENTS 4,170,721 A * 10/1979 Ishibashi et al. ..... 381/360

FOREIGN PATENT DOCUMENTS

JP 06-339192 * 12/1994

* cited by examiner

*Primary Examiner*—Sinh Tran
*Assistant Examiner*—Brian Ensey
(74) *Attorney, Agent, or Firm*—Fulwider Patton Lee & Utecht LLP

(57) ABSTRACT

There is provided a microphone apparatus with an adjusting mechanism that prevents wind noise generated at a sound absorbing hole from perceptively inputted in the structure having a microphone built-in at the back of a panel with a sound absorbing hole.

A sound box is structured between a sound absorbing hole of a panel and a sound perceptible portion of a microphone, and a movable piece that slidably moves in the sound box is formed. A screw rod is annexed to the movable piece, and a disk screwed with the screw rod is restricted and interposed between a tubular portion, serving as an outer frame of the sound box, and a support portion formed at the lower portion. A part of the disk is exposed to the front surface side from a slit of the panel, and the disk is rotated to move the movable piece, whereby changing a resonant frequency of a ventilation space of the sound box and a ventilation cross.

14 Claims, 4 Drawing Sheets

MICROPHONE APPARATUS

This application is a continuation of U.S. patent application Ser. No. 10/442,545, filed on May 21, 2003, now U.S. Pat. No. 6,771,789, which is in turn a continuation of U.S. patent application Ser. No. 09/805,307, filed on Mar. 12, 2001, now U.S. Pat. No. 6,590,988, which are incorporated by reference in their entireties.

BACKGROUND OF THE INVENTION

1. Field of the Invention

The present invention relates to a microphone apparatus, and more particularly to an acoustic structure, which is applied to a radio apparatus, a recording apparatus and the like in which a microphone is built in a microphone case or a main housing, for resolving the problem in which clarity of voice information to be absorbed is lost by a phenomenon in which transmitting voice with a strong sound pressure or under strong wind, wind noise or prosodic features of voices based on various kinds of languages and individual differences are generated.

2. Description of the Related Art

Conventionally, in a mobile-use radio apparatus, a microphone is built in a microphone case, which is cable-connected to a main body. In a handy-type transceiver, a microphone is built in a housing.

In accordance with miniaturization and supersensitization of the microphone, there has been recently adopted a system wherein a small sound absorbing hole is formed on a microphone case or a housing panel and the microphone is held on the back thereof and a sound perceptible portion of the microphone is fixed to the sound absorbing hole to be opposed thereto in this manner.

However, in the apparatuses used outdoors such as the radio receiver and a transceiver, the following problems occur.

More specifically, a speaker must put one's mouth close to the sound absorbing hole and utter a loud voice. Moreover, since a strong current of air occurs along the front surface of the panel under the strong wind, a space, which is formed between the absorbing hole of the panel and the sound perceptible portion, functions as a column of air or a sound box and a so-called "wind noise" is inputted into the microphone, and this makes it difficult for a receiver side to hear the transmitting sound.

Furthermore, a linear sound guide channel is formed between the absorbing hole of the panel and the sound perceptible portion. Accordingly, when the speaker puts one's mouth close to the sound absorbing hole as mentioned above, a strong sound pressure caused by breath directly acts on the sound perceptible portion even in an unvoiced state and a breath sound is voice-outputted, thereby grating on a receiver's ear.

As measures against these problems, the following systems are adopted:

(1) A system in which a portion close to the sound absorbing hole of the panel surface is louvered and the current of air is scattered to prevent occurrence of resonance;

(2) A system in which a sponge or like is interposed between the sound absorbing hole and the sound perceptible portion to eliminate an element such as a column of air or the sound box in order to prevent the sound pressure caused by breath from being directly applied to the sound perceptible portion; and (3) The size of the sound absorbing hole is formed as small as possible, and the sound guide channel is bent at the right angle twice to be guided to the sound perceptible portion of the microphone.

However, since various resonant conditions and sound pressure propagation conditions may be established depending on the state of the sound pressure caused by the uttered sound close to the panel surface and the direction of the wind, univocal louver formation as adopted in measures (1) cannot solve the aforementioned problems. In addition, it is almost impossible to form an ideal louver.

Measures (2) are substantially useful for the wind noise, breath sound and the like. However, this reduces sensitivity as a sound absorbing system and particularly attenuates high frequency components of voice frequency considerably, thereby deteriorating the reception quality on the receiver side.

Measures (3) are useful for the breath sound since the reduction in the sound absorbing hole lowers the sound absorbing efficiency. However, there is no effect on the wind noise since the sound guide channel functions as an element of the column of air.

In the radio apparatus used outdoors, conditions such as the state of noise, direction of the wind, wind force, and the like are frequently changed, and a microphone use environment is variously considered. It is naturally desired that high-quality transmission system be always maintained in any condition.

In addition, the voices represent a great variety of prosodic features based on kinds of languages such English, French, and so on and individual differences in pronunciation characteristics. There has been experimentally known a problem in which the transmission system does not match a voice with a specific prosodic feature and particularly consonants, which belong to the high frequency, become unclear. Microphone apparatuses that are adaptable to such individual circumstances are most desirable.

The aforementioned problems and demands are not limited to the radio apparatuses, and the same can be applied to the portable recording apparatuses.

In consideration of the aforementioned problems, it is an object of the present invention to provide a microphone apparatus, which can easily adjust a transmission system from a panel front surface side in response to circumstances, whereby making it possible to input a high quality voice having neither wind noise nor a breath sound generated and to implement the input of clear voice against various kinds of prosodic features of the voice.

SUMMARY OF THE INVENTION

In accordance with an embodiment of the present invention, an adjusting mechanism for use with a microphone apparatus or sound guide system having a housing with a sound guide channel for guiding a wave form between a sound absorbing hole formed in the housing to a perceptible portion of a microphone is described herein. Such adjustment mechanism is in the form of a sound box having a peripheral wall surface and adjoining first and second surfaces having respective apertures in communication with the sound absorbing hole and perceptible portion. The sound box is positioned in the sound guide channel and includes a movable piece that is slidably engaged with at least one of the surfaces and operable to move within the interior of the sound box so as to interfere with the sound guide channel upon movement of an accessible portion of an actuator coupled to the movable piece.

In a particular aspect of the present invention, the movable piece is a plate coupled to a threaded pin and disc which, when rotated, moves the plate in a linear fashion between the opposing first and second surfaces and alters the volume of the sound box.

In a second embodiment of the invention, the movable piece is substantially disc shaped and rotates around the rim of the peripheral wall surface to alter the path between the sound absorbing hole and perceptible portion of the microphone without altering the volume of the sound box.

In another aspect of the present invention, the actuator may move the movable piece incrementally within the interior of the sound box.

Yet another aspect of the present invention includes the incorporation of a movable piece with a height or cross section that is less than the height or cross section of the sound box.

In accordance with these and other aspects of the invention, the sound box may function as a variable sound filter. In one particular embodiment, the resonant frequency of the adjustable microphone apparatus for guiding sound wave forms between a sound absorbing hole and a sound perceptible portion is changed by the rotational operation of the actuator, whereby making it possible to adjust the variable sound filter to prevent wind noise and breathing sounds and the like from being input to the microphone. Additionally, the adjustment of the variable sound filter can structure the optimal sound input system which is adaptable to even various kinds of prosodic features of the voice.

In the second embodiment, such variable sound filter acts similarly. However, the resonant frequency of the sound guide system is changed when the movable piece is rotated in the sound box. Thus, the shape of the ventilation channel formed between the respective sound absorbing and sound perceptible holes is changed by the angle of rotation of the movable piece. As a result, the resonant frequency of the entirety of the adjustable microphone apparatus is changed, so as to obtain the similar effect.

Other features and aspects of the present invention will become apparent with further reference to the following drawings and specification.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

Preferred embodiments of the microphone apparatus of the present invention will be specifically explained with reference to the drawings.

First Embodiment

Figure 1A:
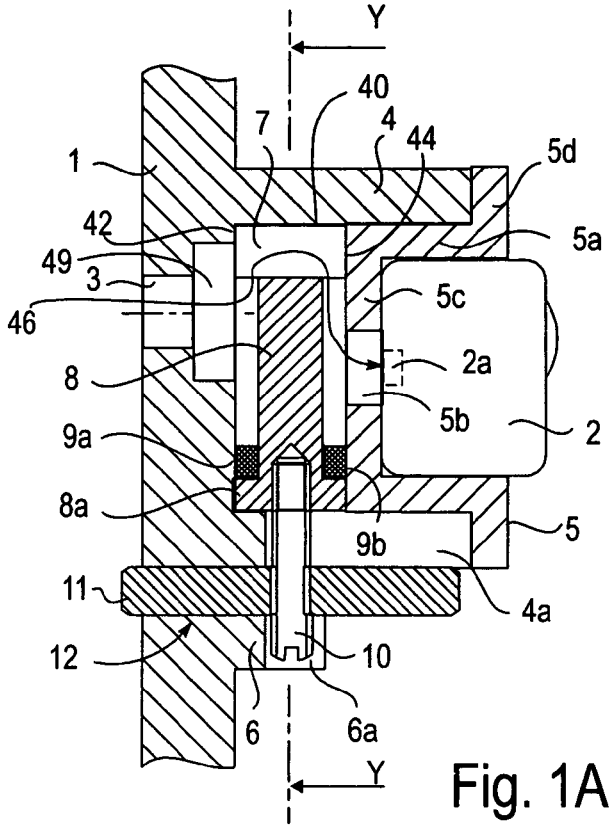
FIG. 1 is a structural diagram of a microphone apparatus according to a first embodiment of the present invention, (A) is a cross-sectional view, (B) is a perspective cross-sectional view taken substantially along line Y—Y of (A), and (C) is a bottom view.
Figure 1B:
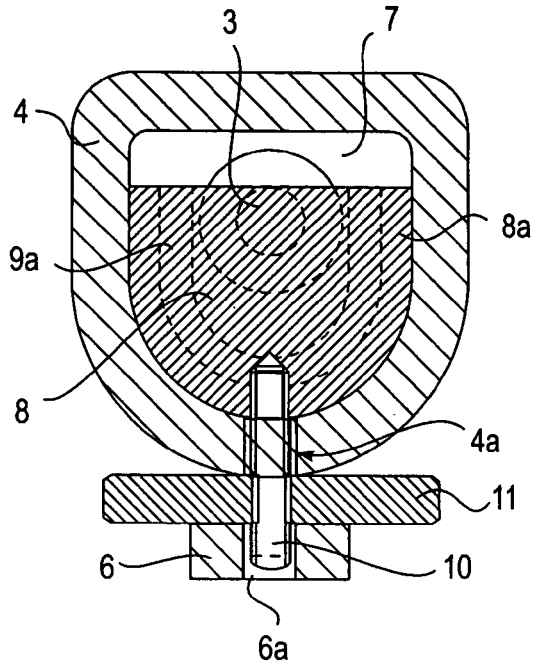

First, FIG. 1 is a structure diagram illustrating a state in which a microphone is attached to a panel of a microphone case of a mobile-use radio apparatus, (A) is a cross-sectional view, (B) is a perspective cross-sectional view taken substantially along line Y—Y of (A), and (C) is a bottom view.

In each view, reference numeral 1 denotes a panel, and reference numeral 2 denotes a microphone. A sound absorbing hole 3 is formed on the panel and a tubular portion 4 with substantially a D-shaped cross section is integrally formed at a back surface side of the sound absorbing forming region. The microphone 2 is attached to the tubular portion 4 on the panel 1 through an adapter 5.

A slot 4*a* with a fixed width is formed from a rear end side at a lower side wall portion of the tubular portion 4 of the panel 1.

A support plate 6 is integrally provided at the lower side of the tubular portion 4 of the panel 1 to have a given distance. The support plate 6 is installed in a standing manner to be parallel with the tubular portion 4, and has a slit 6*a* having the same width as that of the slit 4*a* of the tubular member 4.

The adapter 5 comprises a tubular portion 5*a* into which the microphone 2 is internally fitted, a front surface plate 5*c* having a hole 5*b* formed at a position corresponding to a sound perceptible portion 2*a* of the microphone 2, and a flange 5*d* formed on a rear surface of the tubular portion 5*a* to be directed outwardly. An inner peripheral side 40 or wall surface of the tubular portion 5*a* in circular in agreement with the tube-shaped of the microphone 2, and its outer peripheral side is substantially D-shaped in agreement with the internal shape of the tubular portion 4 of the panel 1.

It is noted that the microphone 2 is attached to the tubular portion 5*a* of the adapter 5 by means such as pressing or adhering, and that the adapter 5 is attached to the tubular portion 4 of the panel 1 by means such as pressing or screwing.

In a state that the microphone 2 is attached to the tubular portion 4 of the panel through the adapter 5, a sound box 7 is formed between the back surface 42 of the panel 1 and the front surface 44 of plate 5*c* of the adapter 5 as shown in FIG. 1(A). A forward aperture 49 in the panel 1 places the sound box 7 in communication with the sound absorbing hole 3. However, a movable piece 8 whose plane is substantially D-shaped is internally fitted/loaded into the sound box 7.

The height of the plane shape of the movable piece 8 is smaller than that of the internal shape of the tubular portion 4 of the panel 1. A rim portion 8*a* is formed along a peripheral edge corresponding to a D-shaped arc side. Only the rim portion 8*a* slideably contacts a peripheral frame wall surface 40 of the sound box 7, the back surface 42 of the panel 1 and the front surface 44 of plate 5*c* of the adapter 5, and other plane regions are formed to be thinner than the rim portion 8*a*.

Moreover, strip felts 9*a* and 9*b* are adhered along the inner side of the rim portion 8*a* of the movable piece 8. The strip felts 9*a* and 9*b* are designed to slide as generating suitable friction between the back surface 42 of the panel 1 and the front surface 44 of plate 5*c* of the adapter 5 in a state that they are slightly compressed respectively.

Then, a screw rod 10 is screwed/fixed to the lower side of the movable piece 8 in a vertical direction. The screw rod 10 is passed through the inner side of the slit 6*a* formed in the support portion 6 through the slit 4*a* formed in the tubular portion 4 of the panel 1. The screw rod 10 is screwed into a screw hole formed about a disk 11, which is interposed between the tubular portion 4 of the panel 1 and the support portion 6. In a state that the disk 11 is interposed therebetween as mentioned above, a part of the disk 11 is formed to have a radius such that the disk 11 projects to the front surface side of the panel 1 through a horizontal slit 12, which is preformed in the panel 1. The disk 11 also has an uneven externally accessible portion 48 in the form of a triangular wave on the side peripheral surface thereof.

Accordingly, at the time of assembling the microphone apparatus, the screw rod 10 is screwed/fixed to the movable piece 8 and passed through the disk 11 in advance. Then, in a state that the screw rod 10 of the assembly is put into the inner side of the slit 4*a* of the tubular portion 4 of the panel 1, the movable piece 8 is internally fitted into the tubular portion 4 and the disk 11 is placed into the slit 12 of the panel 1. After that, the adapter 5 to which the microphone 2 is attached is internally fitted into the tubular portion 4 from the back, whereby completing the structure of FIG. 1.

Figure 1C:
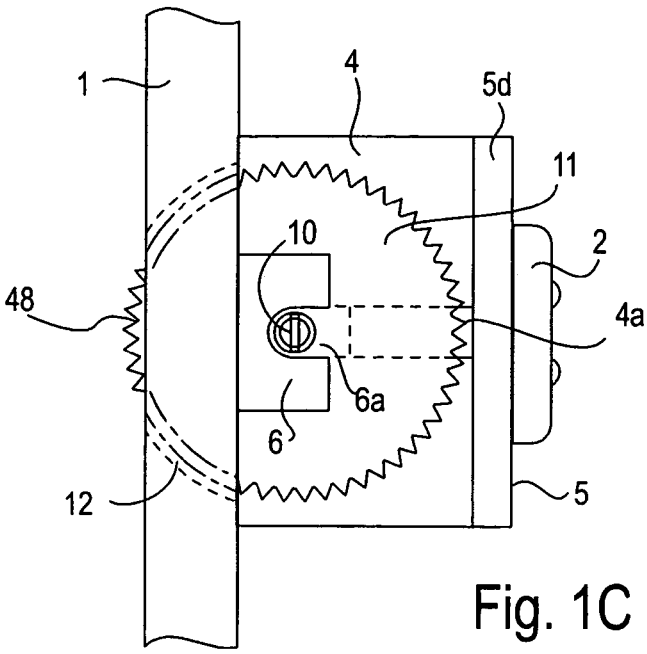

As viewed from the front surface side of the panel 1, the accessible portion 48 (FIG. 1(C)) of the disk 11 is exposed from the slit 12 formed at the lower side of the sound absorbing hole 3.

According to the structure of this microphone apparatus, when the exposed portion 48 of the disk 11 is rotated from the front surface of the panel 1 by a manual operation with an operator's finger, movement of the disk 11 in up and down directions is restricted between the tubular 4 of the panel 1 and the support portion 6. For this reason, the screw rod 10 and the movable piece 8 can be moved in up and down directions by the pair of the disk 11 and the screw rod 10. This makes it possible to variably adjust the volume of a ventilation space formed between the sound absorbing hole 3 of the panel 1 and the sound perceptible portion 2*a* of the microphone 2 in the sound box 7.

Namely, in the sound box 7, the portion of the movable piece 8 other than the rim portion 8*a* and the strip felts 9*a* and 9*b* is concaved. For this reason, unless the movable piece 8 is moved up to the maximum upward limit, a ventilation or sound wave channel, as indicated by directional arrow 46 (FIG. 1(A)), can be ensured between the sound absorbing hole 3 and the sound perceptible portion 2*a*. However, when the movable piece 8 is moved in up and down directions by the rotating operation of the disk 11, the volume of a cross section 13 of the ventilation channel 46 and that of the ventilation space are changed, and this makes it possible to attenuate the sound pressure in a case where the sound presume acting on the sound perceptible portion 2*a* is excessively high. This also makes it possible to adjust a resonate frequency of ventilation system leading to the sound perceptible portion 2*a* from the sound absorbing hole 3.

In addition, the movable piece 8 moves in a state that the rim portion 8*a* is in slidable contact with the back surface 40 of the panel 1 and the front surface 44 of plate 5*c* of the adapter 5, and suitable friction is imparted by the felts 9*a* and 9*b*. As a result, the movable piece 8 is not wobbled by a dimensional tolerance and the like in the sound box 7, and is surely fixed at a position set by the adjustment of the disk 11.

Accordingly, in a case where wind noise and breath sound are absorbed from the sound absorbing hole 3 of the panel 1, it is possible to adjust and set these sounds not to be inputted into the microphone 2 by the rotating operation of the disk 11. Even in a case where the transmitting voice is a foreign language having a special prosodic feature or a speaker's vocalization is inputted with an unclear voice based on the individual difference, flexible adjustment may be carried out to ensure sufficient clearness.

Then, this embodiment has explained the case that is applied to the microphone case of the mobile-use radio apparatus. This simply relates to the microphone mounting structure, and the entirety of the apparatus can be structured in an extremely compact form, so that this can be used as a mechanical structure of the voice input section in a transceiver, a cellular phone, and so on.

Second Embodiment

As in the case of the first embodiment, this embodiment will explain, as an example, the microphone apparatus that relates to the microphone case of the radio apparatus.

In FIG. 4, (A) is a cross-sectional view of the microphone, (B) is a perspective cross-sectional view taken substantially along line Y1—Y1 of (A), (C) is a perspective cross-sectional view taken substantially along line Y2—Y2 of (A), and (D) is a bottom view.

In each view, reference numeral 21 denotes a panel, 22: a microphone, 23: a sound absorbing hole, 24: a tubular portion, which is integral with the panel 21, and 25: an adapter for attaching the microphone 22 to the tubular portion.

Here, the tubular portion 24 is formed at the back surface side 52 of the area where the sound absorbing hole 23 is formed in the panel 21. The basic structure, in which the microphone 22 is attached to the tubular portion 24 through the adapter 25, is the same as the first embodiment. The adapter includes an aperture 25*b* placing the sound box 27 in communication with the sound perceptible portion 22*a* of the microphone 22 (FIG. 4(A)).

Additionally, this embodiment is different from the first embodiment in the points that the tubular portion 24 is cylindrically shaped and that no slit is formed therein.

Figure 2:
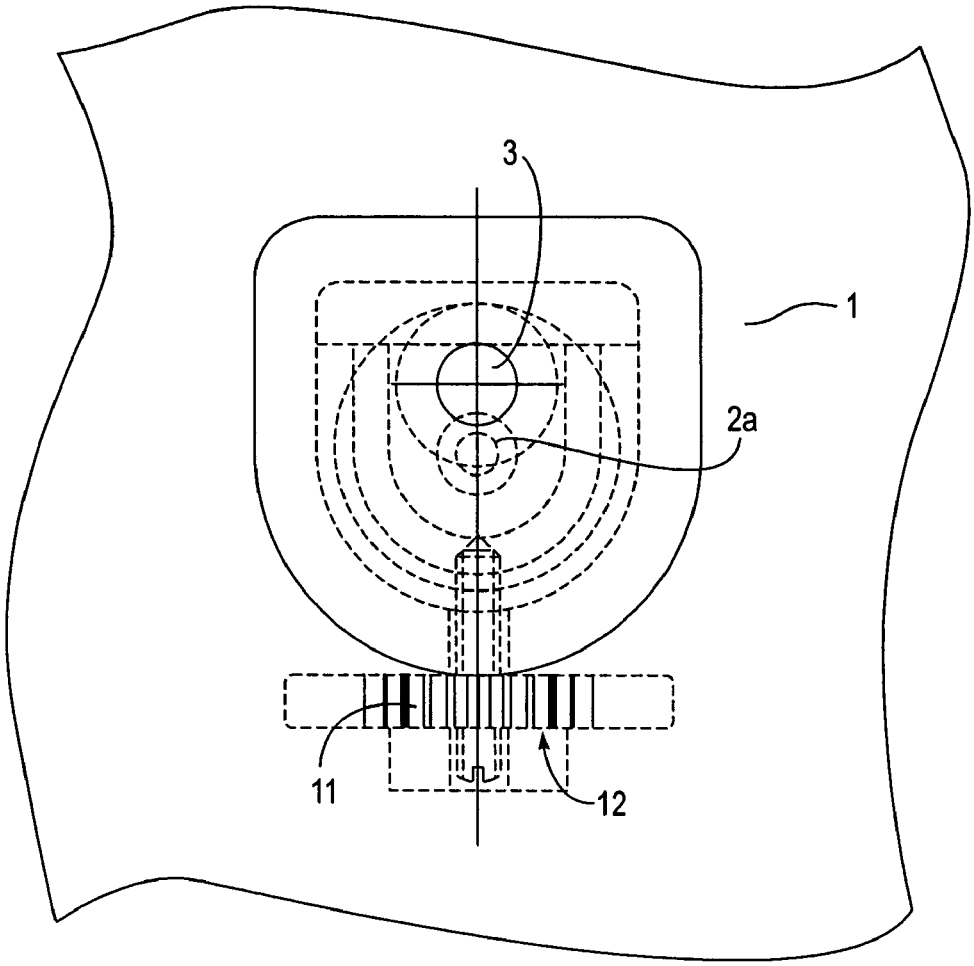
FIG. 2 is a front view seeing the microphone apparatus according to the first embodiment from a front surface side of a panel.
Figure 3:
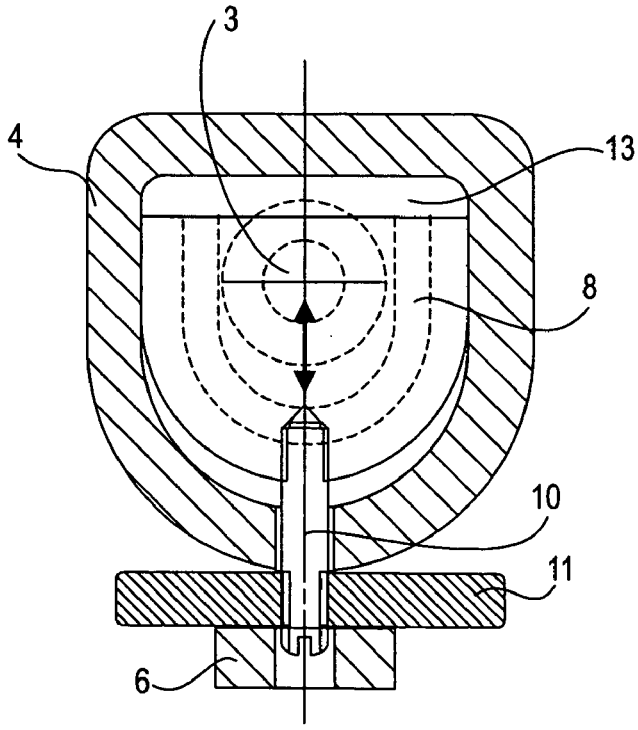
FIG. 3 is a cross-sectional view (corresponding to (B) of FIG. 1) showing an adjusting state of the microphone apparatus according to the embodiment of the present invention.

Moreover, the first embodiment has been explained using the structure in which the sound absorbing hole 3 and the sound perceptible portion 2*a* of the microphone 2 are not on the same straight line as shown in FIGS. 1(A) and 2, but they may be on the same straight line. In the second embodiment, the point, in which the sound absorbing hole 23 and the sound perceptible portion 22*a* of the microphone 22 are not on the same straight line, is an indispensable condition. Namely, the second embodiment also differs from the first embodiment in view of this point. Moreover, in the second embodiment, the support portion 6 is not formed at the back surface of the panel 1 unlike in the first embodiment. Namely, the tubular portion 24 is merely integrally formed at the back surface of the panel 21.

Similar to the first embodiment, according to this embodiment as illustrated in FIG. 4(A)–4(D), when the microphone 22 is attached to the tubular portion 24, a sound box 27 is formed between the back surface 52 of the panel 21 and a front surface 54 of plate 25*c* of the adapter 25. A forward aperture 59 places the sound box 27 in communication with the sound absorbing hole 23. However, a rotation piece 28, which has a plane shaped partially cutting the disk, is internally fitted into the sound box 27.

This rotation piece 28 has the plane shape and a rim portion 28*a* formed along an arc of the outer periphery. Only the rim portion 28*a* slidably contacts an inner peripheral wall surface 50 of the sound box 27, the back surface of the panel 21 and the front surface plate 25*c* of the adapter 25, and other plane regions are formed to be thinner than the rim portion 28*a*.

Teeth are formed on an inner peripheral side of the rim portion 28*a* of the rotation piece 28 abutting against the side of the panel 21 in a predetermined module. The portion of the rim 28*a* facing to the side of the panel 21 serves as an inner gear 28*b*.

Further, in this embodiment, a small gear 29 meshing with the inner gear 28*b* of the rotation piece 28 is formed, and a round axial rod 30 is installed in a standing manner. Then, the round axial rod 30 is internally fitted into a hole 31 formed on the panel 21. Then, its tip end surface 58 (FIG. 4(D)) with a groove for a (–) driver is exposed to the front surface side of the panel 21 through the hole 31.

Accordingly, at the time of assembling this microphone apparatus, the round axial rod 30 is first inserted into the hole 31 of the panel 21 to attach the small gear 29 thereto. Next, the rotation piece 28 is installed into the tubular portion 24 of the panel 21 such that the inner gear 28*b* of the rim portion 28*a* is meshed with the small gear 29. After that, the adapter 25 to which the microphone 22 attached is internally fitted into the tubular portion 24 of the panel, whereby completing the structure of FIG. 4.

Figure 4A:
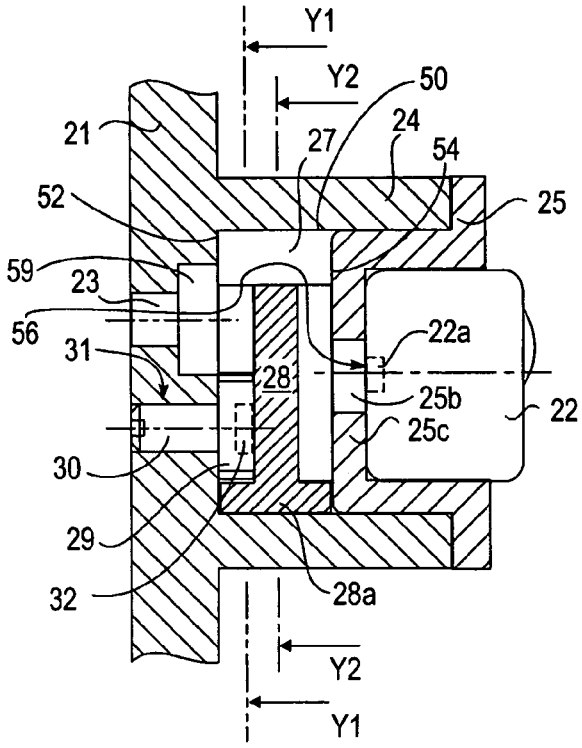
FIG. 4 is a structure diagram of a microphone apparatus according to a second embodiment of the present invention, (A) is a cross-sectional view, (B) is a perspective cross-sectional view taken substantially along line Y1—Y1 of (A), (C) is a perspective cross-sectional view taken substantially along line Y2—Y2 of (A), and (D) is a bottom view.
Figure 4B:
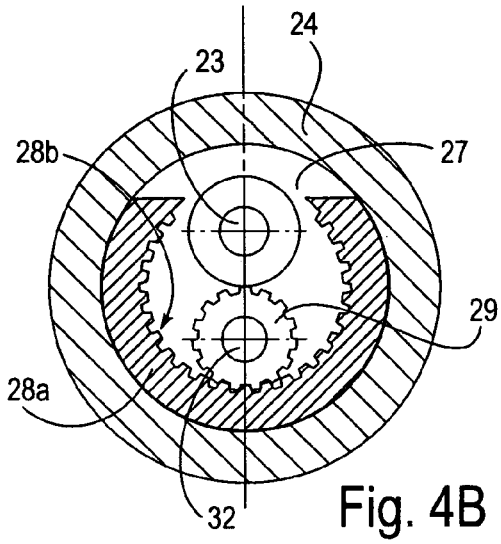
Figure 4C:
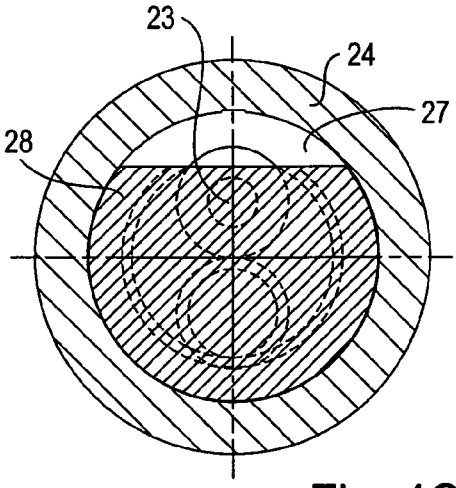
Figure 4D:
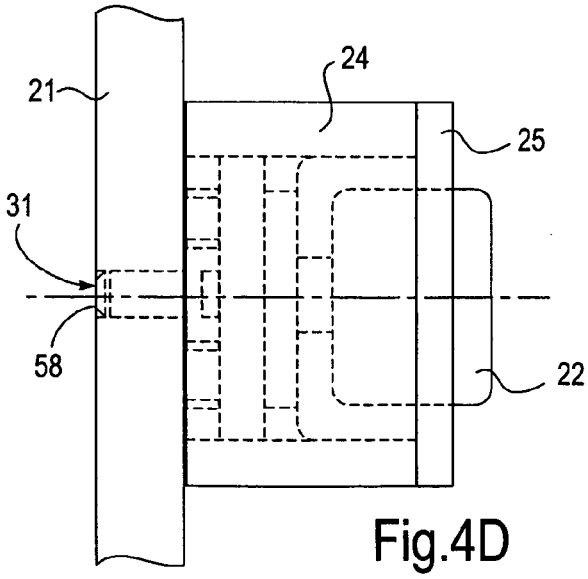
Figure 5:
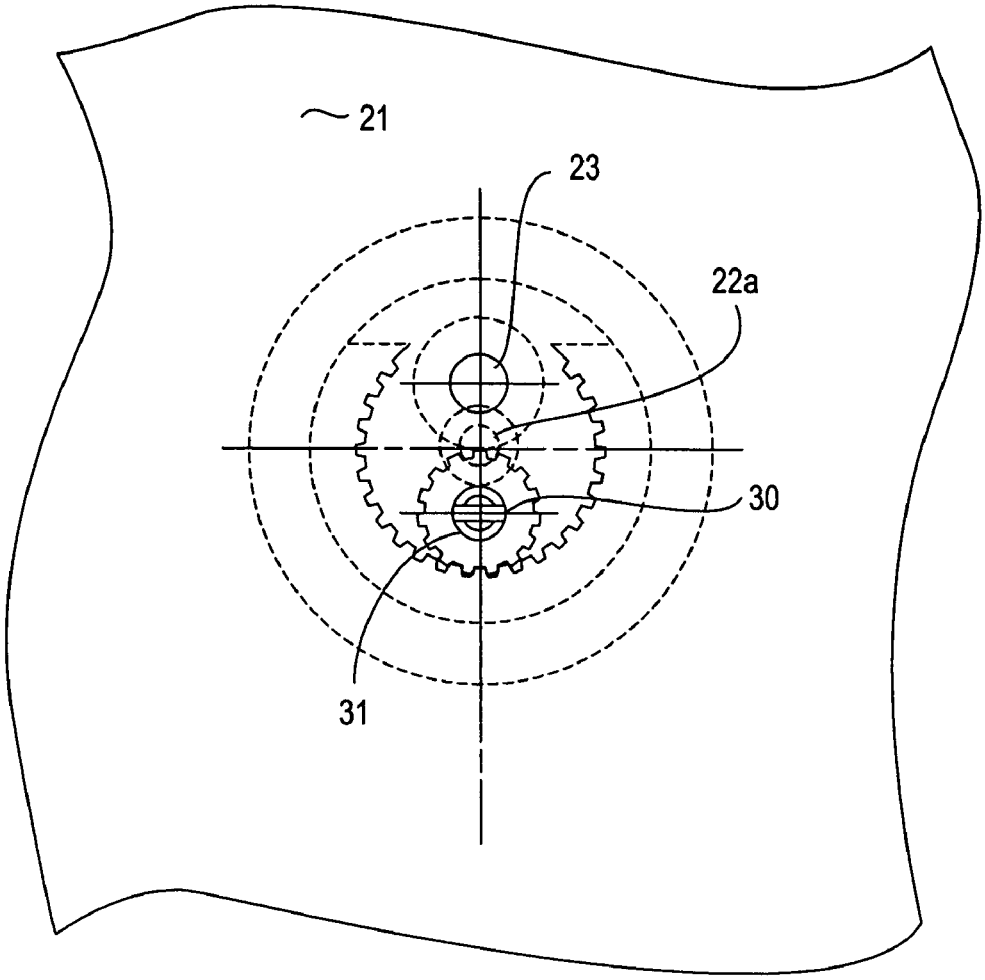
FIG. 5 is a front view seeing the microphone apparatus according to the second embodiment from a front surface side of a panel.
Figure 6:
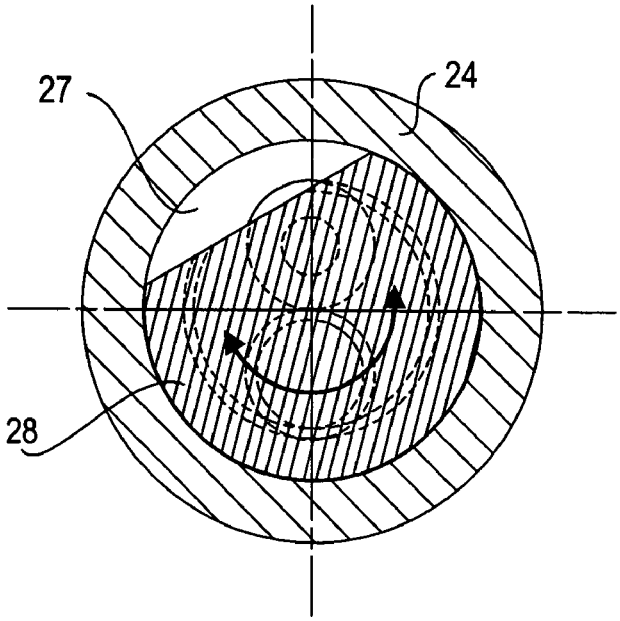
FIG. 6 is a cross-sectional view (corresponding to (C) of FIG. 4) showing an adjusting state of the microphone apparatus according to the second embodiment of the present invention.

Then, as viewed from the front surface side of the panel 21, the tip end 58 (FIG. 4(D)) of the round axial rod 30 is exposed from the hole 31, which is formed at the lower side of the sound absorbing hole 23 as illustrated in FIG. 5.

Additionally, a spot facing hole is formed at an abutting surface side against the rotation piece 28 in the small gear 29. A felt plate 32 is internally fitted into the same spot facing hole in a state that it is slightly compressed. As a result, the small gear 29 and the rotation piece 28 are designed to slide as generating suitable friction.

In the above-structured microphone apparatus, when the tip of the driver is put into the groove of the tip end of the round axial rod 30 exposed to the front surface of the panel 21 and it is rotated, the rotation piece 28 rotates in the sound box 27 based on the meshing relationship between the small gear 29 and the inner gear 28*b* of the rotation piece 28.

As a result, the shape and the volume of a ventilation space, which is formed between the sound absorbing hole 23 of the panel 21 and the sound perceptible portion 22*a* of the microphone 22 in the sound box 27, are unchanged. However, the relative position to the sound absorbing hole 23 and the sound perceptible portion 22*a* is moved in the peripheral direction.

Namely, in the sound box 27, the rotation piece 28 always ensures a ventilation channel as indicated by directional arrow 56 (FIG. 4(A)), between the sound absorbing hole 23 and the sound perceptible portion 22*a*. However, when the rotation piece 28 is rotated by the rotating operation of the round axial rod 30, the ventilation channel is also rotated and changed. This makes it possible to attenuate the sound pressure to some degree in a case where the sound pressure acting on the sound perceptible portion 22*a* is excessively high. This makes it possible to adjust a resonate frequency of a ventilation system leading to the sound perceptible portion 22*a* from the sound absorbing hole 23.

As a result, the same effect as that of the microphone apparatus of the first embodiment can be implemented. Particularly, this is useful to prevent wind noise from being generated at the sound absorbing hole 23 in a specific direction of the wind.

In addition, the rotation piece 28 rotates in a state that the rim portion 28*a* is in slidably contact with the back surface 52 of the panel 21 and the front surface 54 of plate 25*c* of the adapter 25, and fixed friction is imparted to the portion between the small gear 29 and the rotation piece 28 by the felt plate 32. As a result, the rotation piece 28 is not wobbled by a dimensional tolerance and the like in the sound box 27, and it is surely fixed at an angle set by the rotation adjustment of the round axial rod.

The microphone apparatus of the present invention comprises the aforementioned structure and presents the following effects:

In the microphone apparatus that guides a sound wave to the sound perceptible portion 2*a*, 22*a* of the microphone 2, 22 from the sound absorbing hole 3, 23 through the sound guide channel 46, 56 it is assumed that such a microphone is used when a user speaks with a strong voice having a high sound pressure under high noise circumstances or it is used in the open where wind is strong. In this case, there occurs a problem in which wind noise generated at the sound absorbing hole is inputted into the microphone. According to the present invention, this problem can be easily solved by changing the ventilation space in a sound box 7, 27 by a simple adjusting operation from a control section provided at the front surface of the panel 1, 21.

When the speaker must put one's mouth close to the microphone apparatus and utter a vocal sound under high noise circumstances, the breath sound is absorbed by the microphone even in the unvoiced state. The present invention is useful for such a state.

Moreover, when the transmitting voice is a foreign language having a special prosodic feature or the speaker's vocalization is inputted with an unclear voice based on the individual difference, a correction using an electrical filter is almost impossible. According to the adjusting system of the variable sound filter based on the present invention, an optimal voice inputting system can be implemented with respect to various kinds of input states, and voice information with a high degree of clarity can be always transmitted and recorded.

Then, the microphone apparatus relating to each claim can perform adjustment appropriately in response to the use circumstances of equipment with a voice input, and the structure can be obtained in an extremely compact manner. Accordingly, the microphone apparatus of the present invention is suitable for the mobile-use radio apparatus such as the transceiver having the microphone case and the microphone built therein and further the portable recording apparatus.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

What is claimed is:

1. An adjusting mechanism for use in a microphone apparatus having a housing with a said sound guide channel for guiding a wave form from a sound absorbing hole formed in said housing to a sound perceptible portion of a microphone, said adjusting mechanism comprising:

a sound box defined by a peripheral wall surface adjoining a first surface having a first aperture in communication with said sound absorbing hole and adjoining a second surface including a second aperture in communication with said sound perceptible portion of said microphone, an interior of said sound box defining at least a portion of said sound guide channel between said sound absorbing hole and said perceptible portion of said microphone;

a movable piece slidably engaged with at least one of said surfaces and positioned between said first and second surfaces, at least a portion of said movable piece being operable to move within said sound box and alter said sound guide channel between said sound absorbing hole and said sound perceptible portion in said interior of said sound box; and an actuator coupled to said movable piece and having an accessible portion outside of said sound box, said actuator being constructed to slide said movable piece within said sound box to alter said sound guide channel upon movement of said accessible portion.

2. An adjusting mechanism as set forth in claim 1 wherein:

said movable piece is slidably engaged with said peripheral surface and moves in a direction parallel to said first and second surfaces in said sound box.

3. An adjusting mechanism as set forth in claim 1 wherein:

said movable piece is slidably engaged with said peripheral surface and rotates around a circumference of said peripheral surface.

4. An adjusting mechanism as set forth in claim 1 wherein:

said actuator incrementally moves said movable piece within said sound box.

5. An adjusting mechanism as set forth in claim 1 wherein:

said sound absorbing hole includes a first central axis and said sound perceptible portion includes a second central axis askew from said first central axis.

6. An adjusting mechanism as set forth in claim 1 wherein:

said sound box is cylindrical.

7. An adjusting mechanism as set forth in claim 1 wherein:

said sound box is substantially D-shaped in transverse cross-section.

8. An adjusting mechanism as set forth in claim 1 wherein:

said movable piece is operable to interfere with a direct path between said sound absorbing hole and said sound perceptible portion.

9. An adjusting mechanism as set forth in claim 1 wherein:

said movable piece moves in a direction parallel to said first surface, upon actuation of said accessible portion.

10. An adjusting mechanism as set forth in claim 1 wherein:

said movable piece moves in a direction parallel to said second surface, upon actuation of said accessible portion.

11. An adjusting mechanism as set forth in claim 1 wherein:

said actuator is rotably coupled to movable piece.

12. An adjusting mechanism for use in a microphone apparatus having a housing with a said sound guide channel for guiding a wave form from a sound absorbing hole formed in said housing to a perceptible portion of a microphone, said adjusting mechanism comprising:

a sound box defined by a peripheral wall surface adjoining a first surface having a first aperture in communication with said sound absorbing hole and adjoining a second surface including a second aperture in communication with said sound perceptible portion of said microphone, an interior of said sound box coextensive with at least a portion of said sound guide channel between said sound absorbing hole and said perceptible portion of said microphone;

wave form deflection means for moving within said sound box between said sound absorbing hole and said sound perceptible portion and altering said sound guide channel between said sound absorbing hole and said sound perceptible portion in said interior of said sound box; and an actuating means for moving said wave form deflection means within said sound box to alter said sound guide channel.

13. A method for adjusting a sound guide channel and altering a wave form in a microphone apparatus having a housing between a sound absorbing hole formed in said housing and a sound perceptible portion of a microphone, said method comprising:

providing a sound box defined by a peripheral wall surface adjoining a first surface including said sound absorbing hole and adjoining a second surface including said sound perceptible portion of said microphone, said sound box having an interior region defining said sound guide channel between said sound absorbing hole and said perceptible portion, and further having a movable piece slidably engaged with said peripheral surface and positioned between said first and second surfaces and being operable to move within said sound box in a direction parallel to said first and second surfaces;

providing an actuator coupled to said movable piece and having an accessible portion outside of said sound box, said actuator being constructed to slide said movable piece within said sound box to alter said sound guide channel upon movement of said accessible portion;

altering said sound guide channel between said sound absorbing hole and said sound perceptible portion in said interior of said sound box by moving said accessible portion and sliding said movable piece within said sound box.

14. The method as set forth in claim 13 further including:

rotating said accessible portion to slide said movable piece.

* * * * *